US005990775A

United States Patent [19]

Inui et al.

[11] Patent Number: 5,990,775

[45] Date of Patent: Nov. 23, 1999

[54] STATIC ELECTRIC APPARATUS WITH SHIELDING

[75] Inventors: Akifumi Inui, Yokohama; Tsuneharu Teranishi, Kawasaki, both of Japan

[73] Assignee: Kabushiki Kaisha Toshiba, Kawasaki, Japan

[21] Appl. No.: 08/725,240

[22] Filed: Oct. 4, 1996

Related U.S. Application Data

[63] Continuation of application No. 08/372,908, Jan. 17, 1995, abandoned, which is a continuation of application No. 07/888,622, May 27, 1992, abandoned.

[30] Foreign Application Priority Data

May 27, 1991 [JP] Japan ..... 3-120831

[51] Int. Cl.[6] ..... H01F 27/36

[52] U.S. Cl. ..... 336/84 C; 174/35 GC

[58] Field of Search ..... 336/84 R, 84 C, 336/84 M; 174/35 GC

[56] References Cited

U.S. PATENT DOCUMENTS

| | | | |
|---|---|---|---|
| 3,675,175 | 7/1972 | Dutton | 336/84 C |

FOREIGN PATENT DOCUMENTS

| | | | |
|---|---|---|---|
| 55-148410 | 11/1980 | Japan | 336/84 C |
| 58-64010 | 4/1983 | Japan | 336/84 R |
| 59-127819 | 7/1984 | Japan . | |
| 3-285310 | 2/1991 | Japan | 336/84 R |
| 3-114210 | 5/1991 | Japan | 336/84 C |
| 3-159217 | 7/1991 | Japan | 336/84 C |
| 3-272115 | 12/1991 | Japan | 336/84 R |
| 3-289110 | 12/1991 | Japan | 336/84 R |
| 4-53111 | 2/1992 | Japan | 336/84 R |
| 4-123412 | 4/1992 | Japan | 336/84 R |

*Primary Examiner*—Thomas J. Kozma
*Attorney, Agent, or Firm*—Foley & Lardner

[57] ABSTRACT

An elastic molded insulating member such as rubber and elastomers is mounted at the end of an electrostatic shield ring attached to the end of a winding, or an electrostatic shield ring is made of an elastic material. The electrostatic shield is in tight contact with the winding, reliably improving the dielectric strength.

4 Claims, 6 Drawing Sheets

STATIC ELECTRIC APPARATUS WITH SHIELDING

This application is a continuation of application Ser. No. 08/372,908, filed Jan. 17, 1995, which is a continuation of application Ser. No. 07/888,622, filed May 27, 1992, both abandoned.

FIELD OF THE INVENTION

The present invention relates to a static electric apparatus capable of reducing the electric field particularly at winding ends and reducing a power loss of the apparatus.

PRIOR ART

The most important technical subject to allow higher voltage and larger capacity of a static electric apparatus such as transformers and reactors, is how to provide a high dielectric strength and how to reduce a power loss.

There is known a so-called sheet winding type transformer having low and high voltage windings each made of a thin metal sheet and insulating sheet superposed one upon another on an iron core. Transformers of this type have on one hand an advantage of a good winding space factor of core windows, and on the other hand the following disadvantages. Electrostatic shields for reducing the electric field are generally provided at the ends of a high voltage winding. It is preferable to place such electrostatic shields as near a winding as possible in order to reduce the electric field at the ends of the winding. Furthermore, in order to reduce the electric field of the shields themselves and sufficiently reduce the electric field at the ends of the winding, each shield is required to have a sufficiently large size. Electrostatic shields particularly on the outer circumference side of a winding preferably have the inner diameter same as the outer diameter of the winding, so that they can be in tight contact with each other. To this end, a high level work technique is required for machining apparatus components with high dimension precision, together with a high level assembly technique for assembling the components with high accuracy.

Conventionally, in order to realize an expected performance of an apparatus, a complicated shape of an electrostatic shield and a complicated molding die have been used, and a shield ring has been covered with an insulating layer to improve its reliability. However, these approaches result in high manufacturing cost and high price of transformers. Furthermore, it is necessary to change the shape and size of an electrostatic shield in accordance with the ratings of a winding, resulting in a need of preparing an expensive die and a lower work efficiency.

An electrostatic shield for a high voltage winding can be mounted relatively easily on the outer circumference of the winding. However, in the case of an electrostatic shield to be mounted on the inner circumference of a winding, if the diameter is made large in order to improve the electric field reduction, the gap between low and high voltage windings becomes large correspondingly. Therefore, the total dimension of windings becomes large. It is impossible for an electrostatic shield to be mounted on the inner circumference of a high voltage winding after the latter was placed in position. It is therefore cumbersome to mount and fix an electrostatic shield, and it takes much time.

As the voltage and capacity of a static electric apparatus becomes great, an electrostatic shield to be used for this apparatus becomes large and heavy, requiring a support member for supporting the shield. Accordingly, it becomes necessary to improve the dielectric strength between the electrostatic shield at a high potential and the support member at a ground potential, and also to provide an electrostatic shield structure resistant to mechanical vibrations during operation and transportation.

It is conceivable that an eddy current loss will increase due to magnetic flux leakage at the ends of a high voltage winding of a sheet winding type transformer of high voltage and large capacity type. In order to prevent this, it is conceivable to use an electrostatic shield for reducing the electric field and reducing an eddy current loss, the shield having a core made of insulating material on which a thin tape metal is wound without forming one turn (without forming a short circuit), and an insulating layer covering the metal. This shield requires, however, much labor in manufacturing. In addition, since this shield is heavy, it becomes necessary to provide a reinforced support for supporting the shield attached to a sheet winding.

In order to reduce the electric field concentrated to the ends of a tape or sheet winding, an insulating layer is required to have some thickness. However, with a thick insulating layer, the shield metal surface becomes spaced from the winding by the amount corresponding to the insulating layer thickness, resulting in deteriorated electric field reduction. In order to improve the electric field reduction effects, the size of a shield becomes large, resulting in a large dimension of the static electric apparatus.

The above-described problems are also associated with transformers of the type that disk coils each formed of an insulated rectangular conductor are mounted on an iron core. In a transformer of this type, a plurality of disk coils are stacked one upon another in the winding axial direction and interconnected to each other to form low and high voltage windings. Also in the case of this transformer, electrostatic shields are mounted facing the end faces of a winding to reduce the electric field at the ends thereof. In this case, it is a requisite to mount the electrostatic shield as near the winding end face as possible. In order to avoid the electric field concentration to a gap between the shield and winding or between the shield and shield support, and in order to reduce the electric field concentration to the electrostatic shield itself, the shield is required to be structured as having a particular shape. To this end, a particular die is formed and a molded electrostatic shield is mounted. As stated above, also in the case of transformers using disk coils, high manufacturing cost and a number of manufacturing steps are required, similar to the case of sheet winding type transformers.

SUMMARY OF THE INVENTION

It is an object of the present invention to provide a static electric apparatus capable of improving the dielectric strength between an electrostatic shield and winding by mounting the electrostatic shield in tight contact with the winding, and capable of simplifying manufacturing and mounting of the electrostatic shield, while allowing low cost and high reliability.

It is another object of the present invention to provide a static electric apparatus capable of enhancing the mechanical strength of a winding and electrostatic shield by mounting the electrostatic shield in tight contact with the winding, and capable of reducing an eddy current loss.

According to one aspect of the present invention, a static electric apparatus comprises an iron core, at least one winding provided on the iron core, and at least one electrostatic shield ring mounted on the end of the winding, wherein an elastic molded insulating member is mounted at the end of the electrostatic shield ring.

According to another aspect of the present invention, a static electric apparatus comprises an iron core, at least one winding provided on the iron core, and at least one electrostatic shield ring mounted on the end of the winding, wherein the electrostatic shield ring is made of an elastic material.

An elastic molded insulating member is mounted at the end of an electrostatic shield ring attached to the end of a winding, or an electrostatic shield ring is made of an elastic material. Therefore, even if the electrostatic shield is small, a precise shape of the shield can be easily obtained which reliably reduces the electric field at the end of the winding. The dielectric strength between the end of the winding and the end of the electrostatic shield can thus be improved, while reducing an eddy current loss, facilitating mounting the electrostatic shield, and enhancing the mechanical strength.

DETAILED DESCRIPTION OF THE EMBODIMENTS

The present invention will be described in more detail with reference to FIG. 1. In the following description, mainly sheet winding type transformers are described. However, it is noted that the present invention is also applicable to other types of static electric apparatuses such as transformers with rectangular wires.

Figure 1:
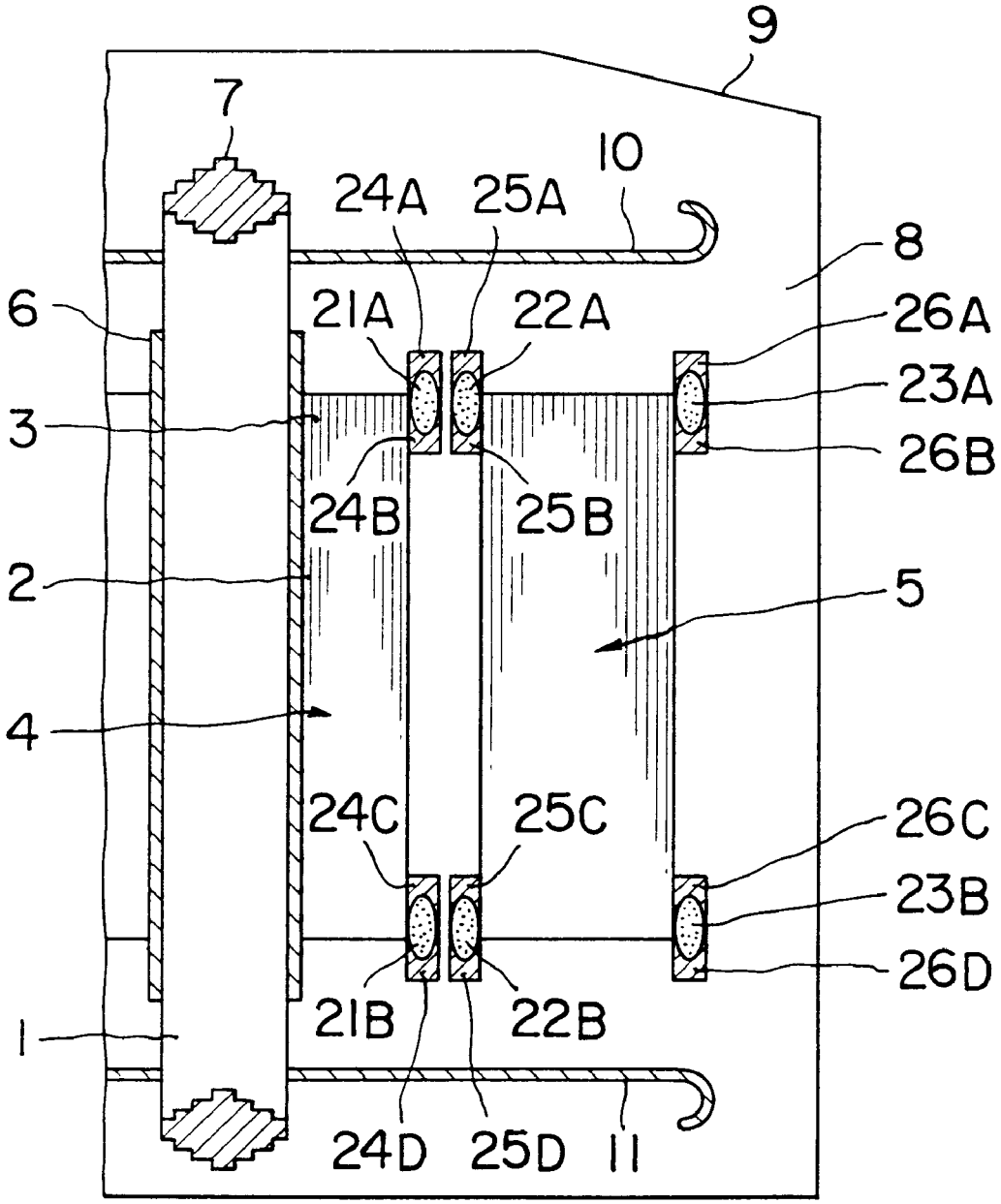
FIG. 1 is a cross section showing an embodiment of a sheet winding type transformer according to the present invention.

FIG. 1 shows the internal structure of a sheet winding type transformer as an example of static electric apparatuses. A low voltage winding 4 and a high voltage winding 5 are provided on an insulating sheath 6 on an iron core 1, each winding being formed with a metal sheet 2 and an insulating film superposed one upon the other. These windings 4 and 5 are supported to be electrically isolated from a ground potential member such as a yoke 7, and housed within a tank 9 containing liquid or gaseous insulator medium 8 such as insulating oil or gas. Magnetic shields 10 and 11 are provided between the tank 9 walls and opposite end faces of the windings 4 and 5 in the winding axial direction. Electrostatic shields for reducing the electric field, six in total, are mounted on the outer circumference of the low voltage winding 4 at its upper and lower opposite ends, and on the outer and inner circumferences of the high voltage winding 5 at its opposite ends. These electrostatic shields are constructed of electrostatic shield rings 21A, 21B, 22A, 22B, 23A and 23B, and molded insulating members 24A, 24B, 24C, 24D, 25A, 25B, 25C, 25D, 26A, 26B, 26C and 26D. The molded insulating members 24A and 24B are attached to opposite sides of the shield ring 21A in the winding axial direction. The other pairs of insulating members are also attached in the similar manner as shown in FIG. 1. The insulating member is made of an elastic material such as rubber and thermoplastic elastomers. In this embodiment, the molded insulating members are attached to opposite sides of the electrostatic shield ring. A molded insulating member may be attached in some case to one side of the electrostatic shield ring where the electric field strength is high, providing fairly good effects. These insulating members are molded such that the shape on the side contacting the electrostatic shield ring tightly fits the ring.

Preferably, the elastic member has a flexural initial elastic modulus of $10^2$ to $10^4$ kg/cm$^2$. Rubber or thermoplastic elastomers with a flexural elastic modulus of this range have a proper elasticity, so that the elastic member has a good adhesion to the shield ring and can be mounted without any gap to the shield ring. Furthermore, an insulating member with an elastic modulus of this range has a proper rigidity, so that the electrostatic shield is hard to deform even when it is squeezed in the winding axial direction by the insulating support member, providing a sufficient mechanical strength.

The sheet winding type transformer of this embodiment constructed as above can reliably reduce the electric field at the opposite ends of each shield ring and reliably improve the insulating characteristic, because the opposite ends of the electrostatic shield ring where the electric field strength is high, are in tight contact with, and fully covered with, the molded insulating member. Furthermore, since the insulating member has elasticity, the shield ring and insulating member are tightly attached together without any small gap. Therefore, dielectric breakage can be prevented even if the electric field is concentrated to a fine gap in an apparatus, particularly a gas insulating type apparatus, thus considerably improving the dielectric strength.

Figure 2:
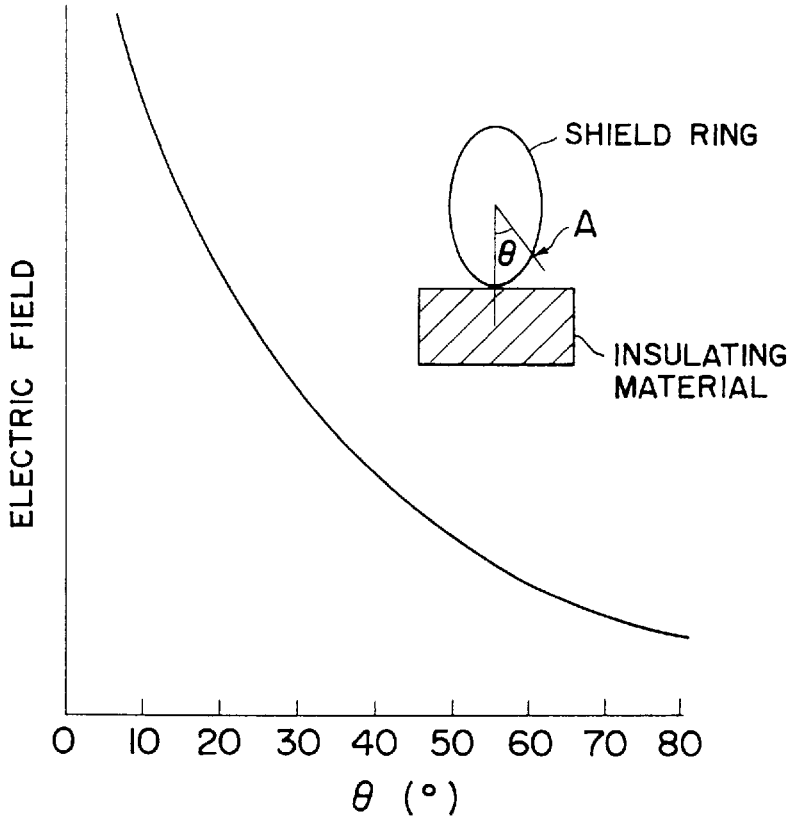
FIG. 2 is a graph showing the electric field between a shield ring and an insulating member contacting the ring.

The calculated electric field at the contact area between the shield ring and the insulating member is shown in FIG. 2. As shown in FIG. 2, the electric field at the surface point A of the ring rises greatly as the point comes near the contact area (as the center angle θ becomes smaller relative to the contact position). When the electric field becomes larger than a dielectric breakage limit of insulating medium, the dielectric breakage occurs. Therefore, it is necessary to mold the insulating member having a shape allowing a tight contact with the shield ring and forming no gap therebetween. The elasticity of the molded insulating member facilitates a tight contact therebetween. In this manner, the electric field can be prevented from being concentrated to the contact area, improving the dielectric strength. If the insulating member is made of thermoplastic resin such as elastomers, molding a desired shape is easy, dispensing with machine work and integrated molding with the shield ring.

The reliability can be improved further if optimum electric characteristics such as dielectric constants, optimum mechanical characteristics such as rigidity, and optimum materials are selected in accordance with the ratings of a static electric apparatus. If the insulating member is made of a material having a low dielectric constant, the electric field between a fine gap, if any, formed between the shield ring and molded insulating member, can be made small. This is because the electric field at the gap is inversely proportional to a ratio of the dielectric constant of the insulating medium in the gap to that of the molded insulating member.

The material of the insulating member is not limited to rubber and elastomers so long as it has an elastic modulus within the above-described range. For example, other plastic materials having excellent electrical and mechanical characteristics such as polymethylpentene may also be used.

Since the molded insulating member is made of elastic material, it has an excellent ability to absorb mechanical vibrations and shocks. The relative positions of apparatus components are not likely to displace during operation or transportation, so that mechanical and electrical characteristics are less liable to degradation. It is also possible to simplify the support structure by integrally supporting the windings and electrostatic shields by aligning the end portion of the molded insulating member with the winding height.

Figure 3:
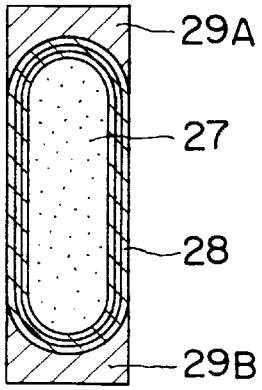
FIG. 3 is an enlarged view showing an embodiment of an electrostatic shield according to the present invention.

The structure of the molded elastic insulating member attached to the electrostatic shield ring is not limited to that shown in FIG. 1. As shown in FIG. 3, an electrostatic shield ring 27 may be covered with an insulating member 28 such as insulating paper or film, to attach molded elastic insulating members 29A and 29B to the ring 27 at its upper and lower opposite ends. With such a structure, the electrostatic shield ring is completely covered with the insulating member, and protected and supported by the molded insulating members at its upper and lower opposite ends. Therefore, any gap will not be formed between the ring and supporting insulating materials. In addition, since the ring is completely covered with the insulating member, the dielectric strength can be improved further.

The material of the molded insulating member 29 has a lower dielectric constant than that of the insulating member 28 covering the shield ring 27. For example, if the cover insulating member 28 is made of PET (polyethylene terephthalate) which has a dielectric constant of about 3.2, the molded insulating member 29 is made of material having a lower dielectric constant such as olefin-based elastomers (dielectric constant about 2.6) or polymethyl pentene (dielectric constant about 2.1).

Figure 4:
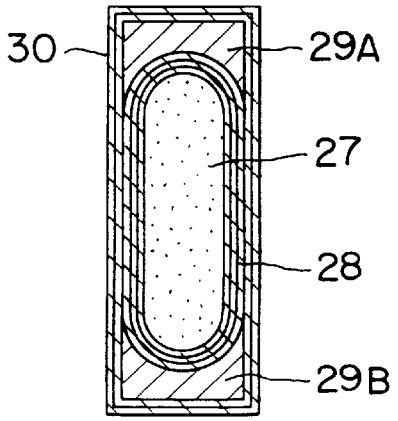
FIG. 4 is an enlarged view showing another embodiment of the electrostatic shield according to the present invention.

As shown in FIG. 4, the electrostatic shield shown in FIG. 3 may be covered with another insulating member 30. With such a structure, the electrostatic shield ring 27 and molded insulating members 29 are integrated more fully to improve adhesion between them and facilitate mounting the electrostatic shield. Furthermore, the outer insulating member 30 can prevent a further discharge even if partial discharge occurs between the insulating member 28 on the shield ring 27 and the molded insulating member 29, thus providing the electrostatic shield having a higher dielectric strength and reliability.

Figure 5:
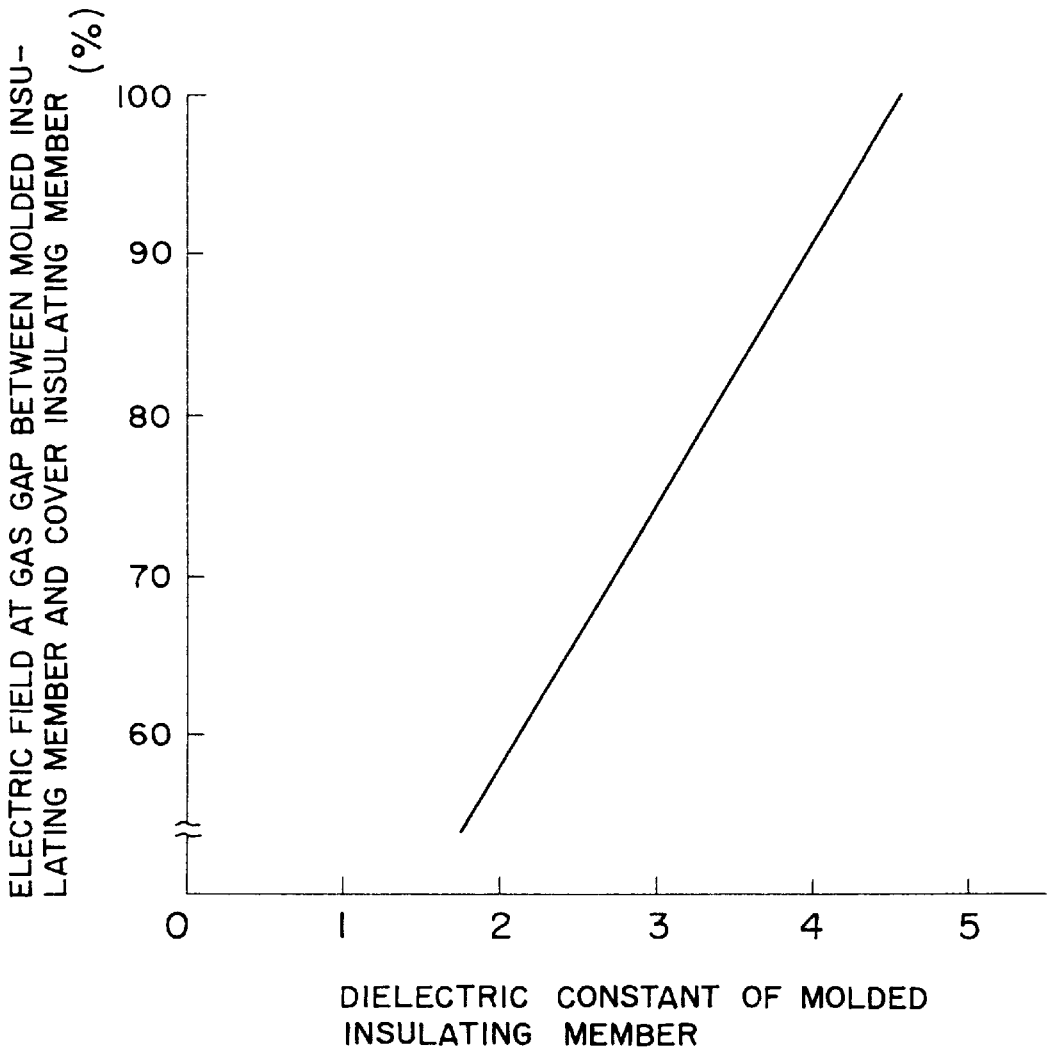
FIG. 5 is a graph explaining the operation of an embodiment of the present invention.

As described above, if the molded insulating member 29 is made of a material having a lower dielectric constant than that of the insulating member 28 covering the shield ring 27, the electric field at a fine gap if any between the molded insulating member 29 and shield ring 27 can be lowered. The calculated electric field at a gap between the molded insulating member 29 and cover insulating member 28 is shown in FIG. 5 for confirmation of the advantageous effects of such double insulating members. In this case, the cover insulating member having a dielectric constant 3.2 was used. The ordinate represents the electric field in percentage, the full scale (100%) standing for the molded insulating member having a dielectric constant 4.5. As shown in this graph, the electric field at a gap between the molded insulating member and cover insulating member changes with the dielectric constant of the molded insulating member. The smaller the dielectric constant of the molded insulating member, the more the electric field concentration to the gas gap is reduced. This means that if the molded insulating member having a smaller dielectric constant is used for a transformer using gaseous insulating medium such as $SF_6$ gas, the insulating structure with higher dielectric strength and hence a more reliable electrostatic shield can be obtained.

In the embodiments shown in FIGS. 3 and 4, the cover and outer insulating members 28 and 30 may be made of a heat shrinking material. By heating the insulating members 28 and 30, the shield ring 27, molded insulating members 29A and 29B and cover and outer insulating members 28 and 30 can be integrally attached together, further, enhancing the electric field reduction and dielectric strength. In the foregoing description, the molded insulating members 29A and 29B are attached to the electrostatic shield ring 27 at its upper lower ends. As described previously, the molded insulating member may be attached in some case to the electrostatic shield ring 27 at one of its upper and lower ends, and the shape and size of the molded insulating members 29A and 29B may be changed as desired.

Figure 6:
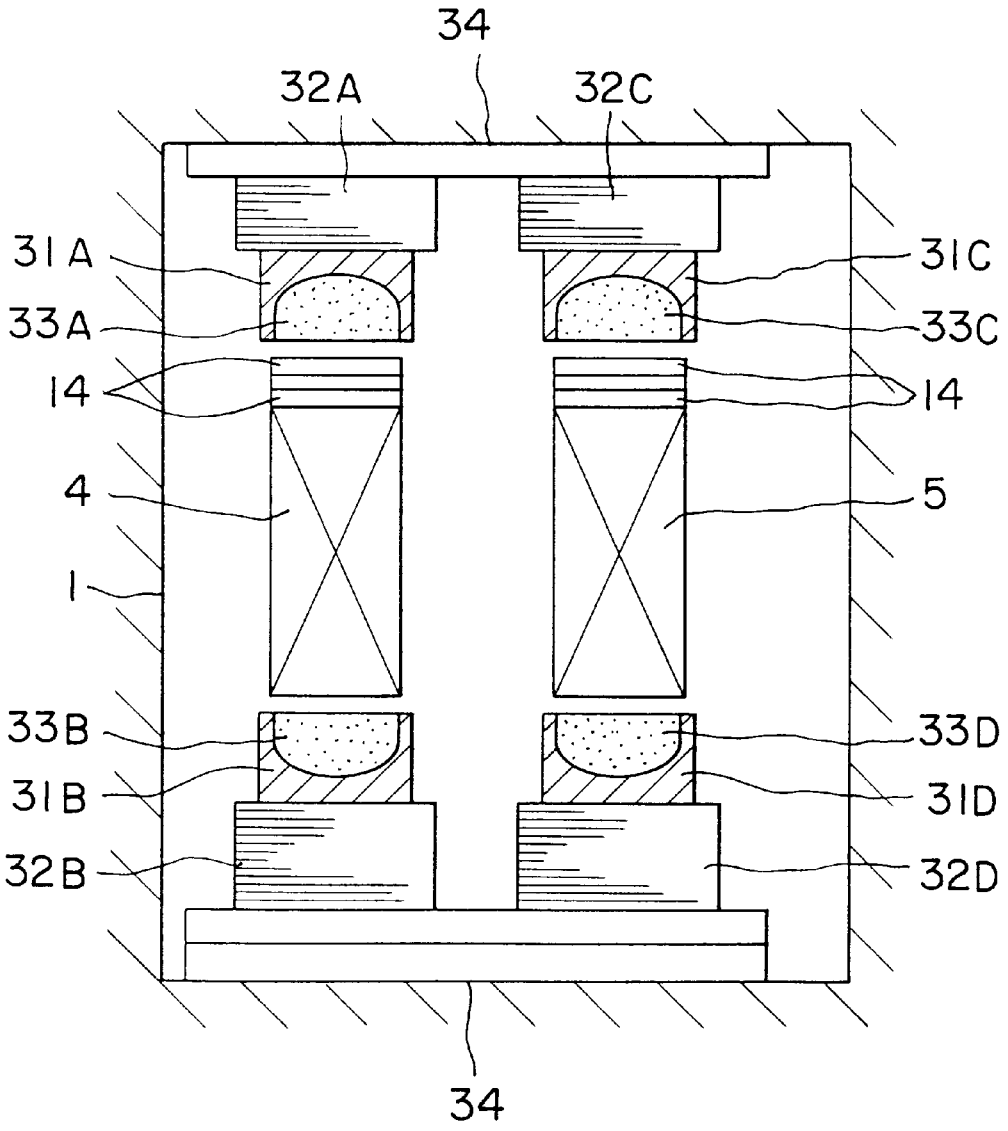
FIG. 6 is a cross sectional view showing an embodiment of a transformer having disk coils each constructed of a rectangular conductor according to the present invention.

FIG. 6 shows another embodiment of the present invention, wherein a transformer has disk coils 14 stacked one upon another, each disk coil 14 being formed with a wound wire of insulated rectangular conductor. The transformer shown in FIG. 6 has a low voltage winding 4 and a high voltage winding 5 each formed with a plurality of disk coils 14 stacked one upon another and wired to each other. Electrostatic shield rings 33A, 33B, 33C and 33D are disposed facing upper and lower surfaces of the low and high voltage windings 4 and 5. Attached to the electrostatic shield rings on the opposite sides to the windings, are molded insulating members 31A, 31B, 31C and 31D made of elastic material such as rubber and thermoplastic elastomers. Also in this embodiment, the electrostatic shield rings and attached molded insulating members 31A, 31B, 31C and 31D may be covered with other insulating members. The ends of the electrostatic shield are protected by the attached molded insulating members having an optimum and smallest shape to efficiently reduce the electric field at the ends of the windings. Therefore, similar to the above-described sheet winding type transformer, the dielectric strength of the electrostatic shield can be reliably and greatly improved. Furthermore, the number of molding steps of insulating members can be reduced, considerably improving the work efficiency. The windings are squeezed between insulated supports 32A, 32B, 32C and 32D to fix them to an iron core yoke 34, thereby increasing the mechanical strength of the windings and electrostatic shields. Since the molded insulating members 31A, 31B, 31C and 31D at the ends of the shields are made of an elastic material, these molded insulating members can absorb vibrations and shocks, and are squeezed tightly without forming any gap, thereby improving the reliability of electrical and mechanical characteristics.

Figure 7:
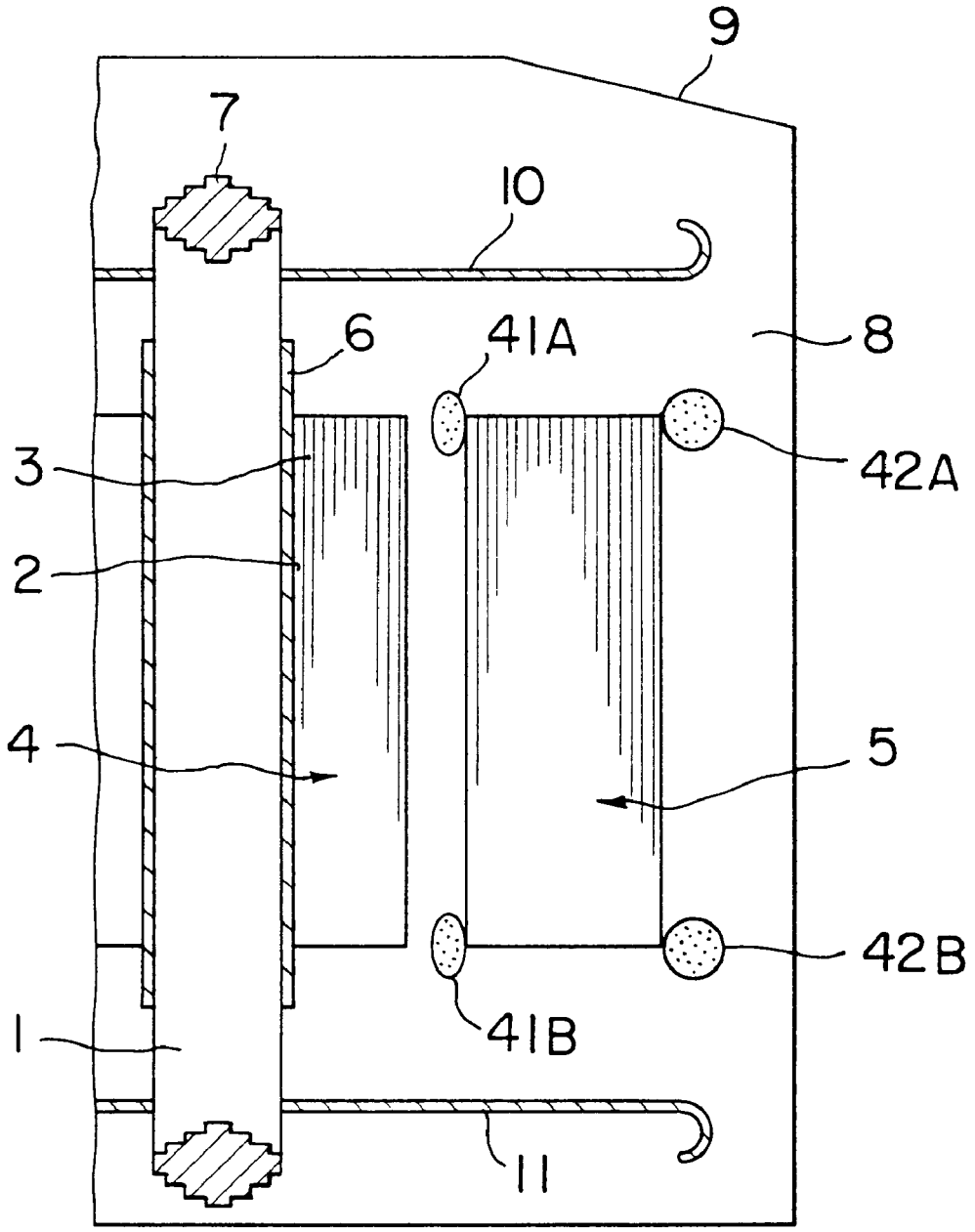
FIG. 7 is a cross sectional view showing another embodiment of the present invention.

FIG. 7 shows another embodiment having an electrostatic shield ring made of an elastic material. In this embodiment, electrostatic shield rings 41A and 41B are mounted on the inner circumference of the high voltage winding 5 at its upper and lower opposite ends, and electrostatic shield rings 42A and 42B are mounted on the outer circumference thereof at its upper and lower opposite ends. These electrostatic shield rings are molded using elastic material such as rubber and thermoplastic elastomers. Each electrostatic shield ring may be made of an insulating material at the inside thereof and a conductive or semi-conductive material only at the surface thereof, or may be all made of a conductive or semi-conductive material. The electrostatic shield rings 42A and 42B are formed to have an inner diameter slightly smaller than the outer diameter of the high voltage winding 5. When mounting the rings on the outer circumference of the high voltage winding 5, they are stretched and thereafter fitted tightly to the winding 5 by the compression force in the radial direction.

The sheet winding type transformer of this embodiment constructed as above can fairly reduce the electric field at the ends of the winding and reliably improve the dielectric strength, because the winding ends having the high electric field strength is tightly attached to the electrostatic shields. Since the electrostatic shield is elastic, the windings and electrostatic shields can be attached together tightly without forming any fine gap. Therefore, dielectric breakage caused by electric field concentration to a fine gap, which is likely to form in a statice electric apparatus of a gas insulating type, can be prevented providing a considerably improved dielectric strength.

Since the electrostatic shields are made of an elastic material, the relative positions of apparatus components are not likely to displace during operation or transportation, so that mechanical and electrical characteristics are less liable to degradation. Furthermore, since the electrostatic shields elastically squeeze the windings, fixing the shields is easy and displacement of turns of the windings and therefore deformation of the windings can be prevented. If the shield is made of a semi-conductive material such as an elastic material containing carbon, eddy current by magnetic fluxes of the shield will not flow and an eddy current loss at the end of the winding can be reduced.

In the embodiment shown in FIG. 7, four electrostatic shields are mounted on the inner and outer circumferences of the high voltage winding 5 at the upper and lower opposite ends. The electrostatic shields on the inner circumference may be formed integrally to form one cylindrical electrostatic shield, and those on the outer circumference may be formed integrally to form one cylindrical electrostatic shield. In this case, the cylindrical electrostatic shield at the outer circumference is structured to squeeze the high voltage winding, to obtain the above-described advantageous effect. The cross sectional shape of each electrostatic shield may be of any desired shape so long as it provides the function of reducing the electric field. The face contacting an insulating support may be made linear so as to match the shape of the insulating support, so that no gap is formed between the support and the shield, reliably improving the dielectric strength and mechanical strength.

Figure 8:
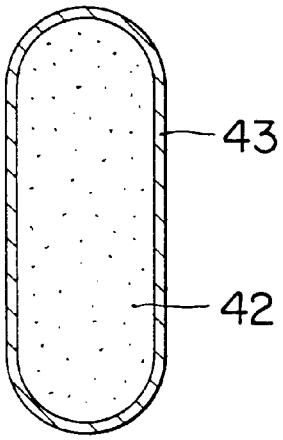
FIG. 8 is a cross sectional view showing an embodiment of an electrostatic shield according to the present invention.
Figure 9:
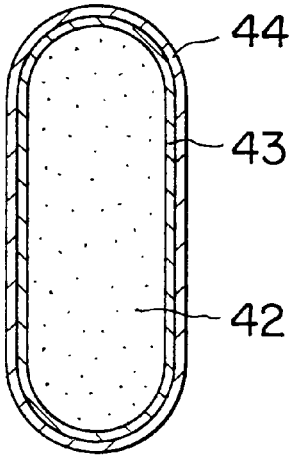
FIG. 9 is a cross sectional view showing another embodiment of the electrostatic shield according to the present invention.

Modifications of the embodiment using an elastic shield ring are possible. For example, as shown in FIG. 8, an electrostatic shield is formed with an electrostatic shield ring 42 with a conductive or semi-conductive layer 43 provided on the surface of the ring 42. The conductive or semi-conductive layer 43 may be coated, bonded or wound, on the shield ring 42. FIG. 9 shows another modification wherein the conductive or semi-conductive layer 43 is covered with an insulating layer 44. With this arrangement, the electric field of the electrostatic shield itself can be reduced to reliably improve the dielectric strength. The shield ring 42 may be made of a conductive or semi-conductive material, with its surface being covered with an insulating layer, resulting in the same advantageous effects as the modification shown in FIG. 9.

Figure 10:
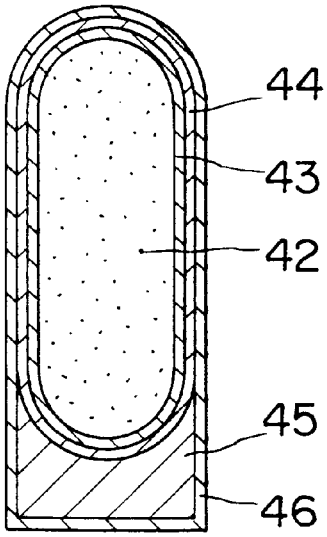
FIG. 10 is a cross sectional view showing a further embodiment of the electrostatic shield according to the present invention.

An electrostatic shield shown in FIG. 10 has a shield ring 42 made of a conductive or semi-conductive material only at the surface thereof or made all of a conductive or semi-conductive material. A molded insulating member 45 made of an elastic material such as rubber and thermoplastic elastomers is attached, directly or via an insulating layer 44, to one (high electric field side) or both of the upper and lower opposite ends of the ring 42 (in FIG. 10 it is attached to one end). With such an arrangement, the dielectric strength can be further improved. The insulating member 45 is molded so as to tightly contact the shield ring 42. The surface not contacting the shield ring 42 may be formed so as to have a desired curvature, or a shape allowing tight contact with the support (not shown) for supporting the electrostatic shield and winding. The shield ring 42 and molded insulating member 45 are integrally covered with a heat shrinking insulating material 46 such as a heat shrinking Teflon (Trade Name) tube. The shield ring 42 and molded insulating member 45 covered with a conductive layer 43 and insulating layer 44 are integrally covered with the heat shrinking insulating tube 46, and heated to obtain the electrostatic shield having their components in fully tight contact.

The heat shrinking work is operated in a vacuum condition so that an electrostatic shield with components in complete tight contact can be obtained without leaving air or gas within the electrostatic shield structure. The inner diameter of the electrostatic shields 21A, 21B, 23A and 23B (refer to FIG. 1) to be mounted on the outer circumferences of the windings may be set slightly smaller than the outer diameter of the low and high voltage windings. The electrostatic shields are stretched and fitted to the outer circumferences of the windings so that they push inwardly the ends of the windings thereafter. In the sheet winding type transformer of the embodiment having such a structure, the elastic molded insulating member 45 tightly contacts the end of the electrostatic shield ring. Therefore, similar to the embodiments described previously, the dielectric strength as well as electrical and mechanical characteristics can be reliably improved.

If the electrostatic shield is made of plastic resin such as elastomers, molding is easy, and optimum electric characteristics such as dielectric constants, optimum mechanical characteristics such as rigidity, and optimum materials can be easily selected in accordance with the ratings of a static electric apparatus, thereby realizing an improved reliability. The embodiment just described above is not limited to a sheet winding transformer only, but is applicable to other transformers using coils made of insulated rectangular conductors.

The present invention is applicable not only to a static electric apparatus of an insulating type using liquid such as oil, but also to other static electric apparatuses of an insulating type using gas such as $SF_6$.

What is claimed is:

1. A static electric apparatus comprising:

an iron core;

at least one winding provided on the iron core;

at least one electrostatic shield ring mounted at an edge of the winding; and a molded elastic insulating member attached to the electrostatic shield ring, wherein the molded insulating member has a shape tightly contacting at least one side of the electrostatic shield ring without any air gap between the shield ring and the molded elastic insulating member, wherein the molded elastic insulating member has an initial elastic modulus of $10^2$kg/cm$^2$ to $10^4$kg/cm$^2$.

2. A static electric apparatus according to claim 1, further comprising an insulating layer between said molded insulating member and said electrostatic shield ring, wherein a dielectric constant of said insulating member is not greater than a dielectric constant of said insulating layer.

3. A static electric apparatus according to claim 1, further comprising an insulating layer encapsulating said molded insulating member.

4. A static electric apparatus according claim 1, wherein the electrostatic shield ring is mounted to a side of the winding.

* * * * *